United States Patent [19]

Neubert

[11] 4,435,451

[45] Mar. 6, 1984

[54] FLOOR MATS OF THE WASHABLE, DIRT ADSORBING TYPE

[75] Inventor: Robert Neubert, Hornslet, Denmark

[73] Assignee: Clean-Tex A/S, Morke, Denmark

[21] Appl. No.: 293,088

[22] Filed: Aug. 17, 1981

[51] Int. Cl.[3] ..... A47G 27/04

[52] U.S. Cl. ..... 428/15; 428/82; 428/85; 428/88; 428/95; 428/192; 428/193; 428/194

[58] Field of Search ..... 428/15, 82, 85, 95, 428/88, 192, 193, 194

[56] References Cited

U.S. PATENT DOCUMENTS 2,254,210 9/1941 Cunnington ..... 428/88
4,054,700 10/1977 Cooper ..... 428/82

FOREIGN PATENT DOCUMENTS 815083 6/1959 United Kingdom .

*Primary Examiner*—Marion McCamish
*Attorney, Agent, or Firm*—Earle R. Marden; H. William Petry

[57] ABSTRACT

Floor mats of the washable, dirt adsorbing type, so-called "service mats", consist of a rubber backing and a nap top layer vulcanized to the top side of the backing such that the outer edge portion of the backing constitutes a frame portion about the nap layer. The mats are produced either as strong "utility mats" based on a black rubber backing or as "appearance mats" based on a backing of colored rubber. According to the invention a "utility mat" is provided which is additionally an "appearance mat", the said frame portion of the black rubber backing being constituted or covered by a layer of colored rubber. The two types of rubber are vulcanized together. The colored rubber and even the black rubber may be reinforced by admixture with synthetic fibres.

2 Claims, 3 Drawing Figures

FLOOR MATS OF THE WASHABLE, DIRT ADSORBING TYPE

Figure 1:
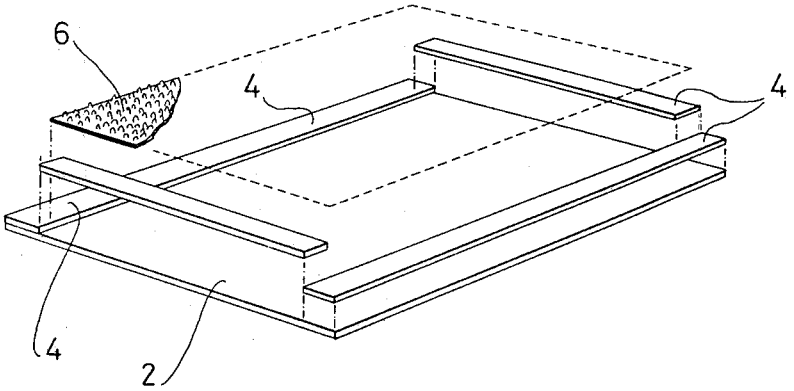

This invention relates to a floor mat of the washable, dirt adsorbing type comprising a rubber backing for a preferably tufted nap of a soft yarn material, the top side of the backing having a nap-free frame area along the edges of the mat.

Mats of this character are produced in two basically different types, viz. so-called utility mats and so-called appearance mats, according to the type of backing material as used therein. The utility mats are made with a backing of "black rubber", i.e. a thin and strong plate material based on lampblack as filler material, this even today being the best and strongest rubber material available. In order to match the black frame area portion of the backing it is customary to produce the mats with a nap made of a grey yarn, optionally a cotton based yarn which is well washable and well suited to be impregnated by a dust binding oil subsequent to the washing of the mat and the renewed use of the mat. It is generally admitted that these grey and black utility mats, although they are highly efficient and durable and advantageous in every other respect, suffer from the disadvantage that they are not at any particularly attractive appearance.

The mats of the type in question are used primarily in non-private surroundings, i.e. in shops, offices, factories etc., and in some of these places it is desirable that the mats should present themselves not as black and grey only, but generally as colored elements. The nap, of course, may easily be colored as desired, but the high quality black type rubber backing cannot be replaced by colored rubber without an associated reduction of the quality, because an equally strong colored rubber material has not been developed so far. Thence the distinction between "utility mats" and "appearance mats", of which the latter are generally of a reduced quality.

It is the purpose of this invention to provide for an improved mat of the type referred to in the opening paragraph, whereby an "appearance mat" is produceable with a generally improved quality.

According to the invention the backing as consisting of "black" rubber or a corresponding high quality material is provided with a top layer of a colored rubber material at least in the said frame area and preferably substantially solely in said frame area.

Generally the available colored types of rubber are well suited to be joined with the black rubber by a vulcanization process as used anyway in the mat production, for securing the nap to the backing, the nap normally being pre-tufted on a thin carrier sheet which is placed on a backing member such that by a following treatment in a vulcanization press the bottom portions of the tufted nap get intimately joined with the backing member.

For producing a mat according to the invention it is preferable to provide a sandwich pre-assembly consisting of a backing member of black rubber and four plate strips of a desired colored rubber laid onto the edge areas of the backing member top side to form a frame portion thereon, and a topmost layer consisting of the said tufted carrier sheet having such a size that it extends just beyond the inner edges of the colored frame strips, whereafter this pre-assembly is treated in a vulcanization press.

According to an important aspect of the invention it has been found that the colored rubber material may be reinforced to show a generally improved quality by incorporating in the rubber mass an amount, e.g. 5%, of synthetic fibres such as polypropylene or polyester fibres, and even the black rubber backing member may be reinforced in the same manner.

Through the colored frame strips are themselves backed by the edge area of the backing member and are thus held in a stabilized manner, they will nevertheless show a still higher stability and quality, e.g. as far as wear resistance is concerned, when they consist of the said fibre reinforced material.

Figure 2:
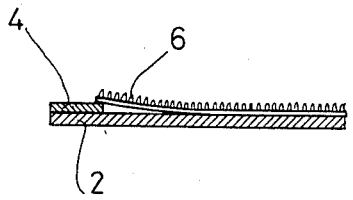
Figure 3:
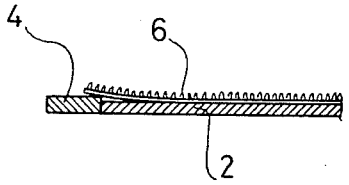

In the following the invention is described in more detail with reference to the accompanying drawing, in which:

FIG. 1 is a perspective exploded view illustrating a preferred manner of producing a mat according to the invention, FIG. 2 is a partial sectional view of the pre-assembly shown in FIG. 1, and FIG. 3 is a similar view of a modified embodiment.

The mat assembly shown in FIG. 1 comprises a lowermost backing member 2 made as a rectangular plate member of "black" rubber, i.e. a strong rubber material based on lampblack as filler material. Onto the top side edge areas of this member is laid four plate strips 4 made of colored rubber and arranged so as to form a frame about the remainder of the exposed top side of the backing member 2. Onto this subassembly is laid a nap sheet 6 consisting of a thin carrier sheet of any suitable material, which has in previous operation been provided with a tufted nap of cotton or synthetic yarn, colored as desired to match the color of the frame pieces 4. The nap sheet 6 is slightly larger than the central area of the backing member 2 as left exposed by the frame strips 4, i.e. the outer edges of the nap sheet 6 will just cover the inner edge areas of the strips 4, as more clearly shown in FIG. 2.

Thereafter the mat assembly is placed in a vulcanization press, and the various layers are joined by the heat and the pressure therein, as already well known for joining the nap sheet 6 with a rubber backing.

The frame strips 4 may have any desired thickness, even down to a very small thickness, and though the colored rubber material, of which they consist, is not as strong as the black rubber of the backing member 2, these strips will nevertheless constitute a reinforcement of the edge portions of the mat, i.e. a reinforcement just where it is needed at most or is of maximum effect. At the same time the colored frame material will add to the black rubber utility mat the qualification of additionally being an "appearance mat".

As shown in FIG. 3 it will even be possible to provide the colored frame strips 4 as outermost frame members laid edgewise against the outer periphery of the central backing member 2. When the colored rubber material of the strips 4 is of an ordinary non-reinforced type which is generally weaker than the black rubber material of the central backing portion 2 it may be desirable to make use of framing strips 4 of increased thickness.

However, experiments have shown that it is in fact possible to reinforce the colored rubber material by adding to the rubber material an amount of some 5% or between 2% and 10% of synthetic fibres e.g. polypropylene or polyester fibres, whereby the colored material is no longer as weak as the conventional "appearance mats", and the necessary thickness of the frame strips—both in FIG. 1 and FIG. 3—may thus be reduced as compared with a non-reinforced material, or in other words an "appearance mat" may be produced which is hardly distinguishable from a "utility mat" from a quality point of view.

Experiments have shown that also the material of the black rubber backing member 2 may be pronounced reinforced by adding to the rubber mass an amount of e.g. some 5% or between 2% and 10% by weight of synthetic fibres, preferably of polyester or polypropylene and of a length of some 5–10 cm.

It will be within the scope of the invention to use a colored top layer or sheet 4 covering the entire black rubber backing member 2.

What is claimed is:

1. A method of producing a washable, dust absorbing mat having a rubber backing, a nap of a soft yarn material on a top side of said rubber backing and a nap-free frame area along the edges of the mat, comprising the steps of preparing a pre-assembly consisting of a backing member of a "black" non-colorable rubber, a frame portion of a colored rubber or rubber-like material placed in contact with at least a top side edge area of the backing member, and an uppermost nap sheet extending outwardly to beyond the inner edge of the frame portion on a top side thereof, and subjecting this pre-assembly to heat and pressure in a vulcanization press so as to form said pre-assembly into a single unitary mat structure.

2. A washable dust absorbing mat produced by the method of claim 1.

* * * * *